US007529596B2

(12) United States Patent
Okamoto

(10) Patent No.: US 7,529,596 B2
(45) Date of Patent: May 5, 2009

(54) KNITTING METHOD OF KNIT PANTS, KNIT PANTS, AND KNITTING PROGRAM OR LETTING FLAT KNITTING MACHINE KNIT THE KNIT PANT

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 359 days.

(21) Appl. No.: 10/585,853

(22) PCT Filed: Jan. 12, 2005

(86) PCT No.: PCT/JP2005/000237

§ 371 (c)(1),
(2), (4) Date: Jul. 12, 2006

(87) PCT Pub. No.: WO2005/068698

PCT Pub. Date: Jul. 28, 2005

(65) Prior Publication Data

US 2008/0229787 A1 Sep. 25, 2008

(30) Foreign Application Priority Data

Jan. 14, 2004 (JP) ..... 2004-006750

(51) Int. Cl.
*D04B 7/30* (2006.01)

(52) U.S. Cl. ..... 700/141; 66/64; 66/177

(58) Field of Classification Search ..... 66/64, 66/70, 169 R, 170, 171, 177, 189
See application file for complete search history.

(56) References Cited

U.S. PATENT DOCUMENTS

| | | | | |
|---|---|---|---|---|
| 5,361,607 | A * | 11/1994 | Mitsumoto et al. | 66/69 |
| 6,658,900 | B2 * | 12/2003 | Okamoto | 66/64 |
| 6,748,770 | B2 * | 6/2004 | Okamoto | 66/64 |
| 7,212,881 | B2 * | 5/2007 | Kazuyoshi | 66/176 |
| 2003/0106344 | A1 | 6/2003 | Okamoto | |
| 2004/0065123 | A1 * | 4/2004 | Okamoto | 66/49 |

FOREIGN PATENT DOCUMENTS

| | | | |
|---|---|---|---|
| EP | 0 508 712 | A1 | 10/1992 |
| EP | 1 367 162 | A1 | 12/2003 |
| JP | 6-240548 | A | 8/1994 |
| JP | 2000-345402 | A | 12/2000 |
| WO | WO 01/88243 | | 11/2001 |
| WO | WO 02/063085 | A1 | 8/2002 |

* cited by examiner

*Primary Examiner*—Danny Worrell
(74) *Attorney, Agent, or Firm*—Rothwell, Figg, Ernst & Manbeck, P.C.

(57) ABSTRACT

A knitting method of knit pants knitted using a flat knitting machine, wherein the knitting starts at a side part on either right side or left side including a side part of a vertical rise part and a side part of a leg part and ends at a side part on the other leg side including a side part of a vertical rise part and a side part of a leg part. A front knitted fabric part and a back knitted fabric part are knitted in the following steps so that a length of the front knitted fabric part from the side to the crotch can be made shorter than a length of the back knitted fabric part from the side to the crotch. The steps comprises the first step of doing the knitting to set up to join and knit the side part of the vertical rise part and the side part of the leg part on the one leg side, the second step of knitting the vertical rise part and leg part of the front knitted fabric part on the one leg side and also knitting the vertical rise part and leg part of the back knitted fabric part on the one leg side, the third step of joining together and binding off inside leg joining parts of the leg parts on the one leg side, the forth step of doing the knitting to set up to join and knit the inside leg joining parts of the leg parts on the other leg side, the fifth step of knitting the vertical rise part and leg part of the front knitted fabric part on the other leg side and also knitting the vertical rise part and leg part of the back knitted fabric part on the other leg side, and the sixth step of joining together and binding off the side part of the vertical rise part and the side part of the leg part on the other leg side. This knitting method can provide the knit pants that fit more beautifully to one's figure and look more beautiful externally when wearing.

12 Claims, 9 Drawing Sheets

(6)

(7)

(8)

(9)

(6)

(7)

(8)

(9)

(10)

(6)

(7)

(8)

(9)

(10)

KNITTING METHOD OF KNIT PANTS, KNIT PANTS, AND KNITTING PROGRAM OR LETTING FLAT KNITTING MACHINE KNIT THE KNIT PANT

CROSS REFERENCE TO RELATED APPLICATION

This application is a 35 USC § 371 National Phase Entry Application from PCT/JP2005/000237, filed Jan. 12, 2005, and designating the United States.

TECHNICAL FIELD

The present invention relates to a knitting method of knit pants, to knit pants, and to a knitting program for letting a flat knitting machine knit the knit pants.

BACKGROUND ART

In general, when knit pants are knitted seamlessly using a flat knitting machine, the back knitted fabric and the front knitted fabric are knitted in tubular form joined together continuously, using a front needle bed and a back needle bed of the flat knitting machine. For example, when the knit pants are knitted using a two-bed flat knitting machine having the front and back needle beds, the knitted fabrics are knitted with every other needles of the respective needle beds. For example, the front knitted fabric is knitted primarily with odd needles of the front needle bed and the back knitted fabric is knitted primarily with even needles of the back needle bed.

Then, the knit pants are produced by the process of knitting first two leg parts in tubular form stating at hems, followed by joining the two leg parts together at the crotch to form a tubular hip part, as shown in FIG. 6 of Patent Document 1.

Patent Document 1: JP published official gazette No. 2001-88243 (FIG. 6) of Japanese translation of PCT patent application

DISCLOSURE OF THE INVENTION

Problem to be Solved by the Invention

Meanwhile, it is general that the knit pants are knitted from hems of leg parts toward a waist part, during which several processes are taken to make the knit pants fit to one's body as beautifully as possible, including a process of forming a gore at a crotch joining part, a process of deepening leg openings, and a process of forming the knit pants in a swelled form by adjusting widening stitches and narrowing stitches in the back knitted fabrics. When the knit pants are formed in such a swelled form while being knitted in tubular form from the hems toward the waist part, it is required that the narrowing or widening stitches be formed in the course of the knitting. The narrowing or widening stitches are often formed particularly in externally visible places of the pants when wearing. Under the circumstances, the knit pants having a more beautiful appearance have been wanted earnestly.

In the light of the actual circumstances mentioned above, the present invention has been developed. It is an object of the present invention to provide a knitting method of knit pants that look beautiful externally and fit more beautifully to one's figure when wearing. It is another object of the present invention to provide knit pants produced by the same knitting method. It is still another object of the present invention to provide a program for letting a flat knitting machine knit the knit pants having a beautiful appearance.

Means for Solving the Problem

A knitting method of knit pants of the present invention is a knitting method of knit pants knitted using a flat knitting machine having at least a pair of front and back needle beds extending in a transverse direction and disposed opposite to each other in a cross direction, at least either of which is capable of being racked in the transverse direction so that loops can be transferred between the front and back needle beds.

The present invention provides a knitting method of knit pants, wherein the knitting starts at a side part on either right leg side or left leg side including a side part of a vertical rise part and a side part of a leg part and ends at a side part on the other leg side including a side part of a vertical rise part and a side part of a leg part, and a front knitted fabric part and a back knitted fabric part are knitted in the following steps so that a length (a thigh width) of the front knitted fabric part from the side to the crotch is shorter than a length (a thigh width) of the back knitted fabric part from the side to the crotch.

In the first step, the knitting to set up to join and knit the side parts of the front and back knitted fabric parts on the one leg side, the side parts including the side parts of the front and back knitted fabric parts of the vertical rise part and leg part on the one leg side is done, using the front and back needle beds. In the second step, the front and back knitted fabric parts are knitted on the one leg side, wherein the vertical rise part and leg part of the front knitted fabric part are knitted, with the vertical rise part and leg part of the back knitted fabric part held to one of the needle beds, and also the vertical rise part and leg part of the back knitted fabric part are knitted, with the vertical rise part and leg part of the front knitted fabric part side held to the other needle bed. In the third step, inside leg joining parts of the front and back knitted fabric parts of the leg parts of on the one leg side are joined together and bound off. In the forth step, the knitting to set up to join and knit the inside leg joining parts of the front and back knitted fabric parts of the leg parts on the other leg side. In the fifth step, the front and back knitted fabric parts are knitted on the other leg side, wherein the vertical rise part and leg part of the front knitted fabric part are knitted, with the vertical rise part and leg part of the back knitted fabric part held to one of the needle beds, and also the vertical rise part and leg part of the back knitted fabric part are knitted, with the vertical rise part and leg part of the front knitted fabric part held to the other needle bed. In the sixth step, the side parts of the front and back knitted fabric parts on the other leg side are joined together and bound off, the side parts including the front and back knitted fabric parts of the vertical rise part and leg part.

The expression that "the knitting starts at a side part on either right leg side or left leg side including a side part of a vertical rise part and a side part of a leg part and ends at a side part on the other leg side including a side part of a vertical rise part and a side part of a leg part" indicates that courses are formed in a vertical direction of the knit pants when viewed from a wearer putting on the knit pants.

In the knitting method of the present invention, it is preferable that the front and back knitted fabric parts are knitted so that the length under the crotch of the back knitted fabric part can be made shorter than that of the front knitted fabric part and also the inside leg joining part of the front knitted fabric part and the inside leg joining part of the back knitted fabric part can be made correspond in length to each other when joined together.

The following knitting procedures are taken to make the inside leg joining parts on the right leg side and left leg side correspond in length to each other. At least one of the front and back knitted fabric parts is subjected to a doubling-for-contraction process to reduce the number of stitches or a widening-for-expansion process to increase the number of stitches from the time the knitting to set up and knit the side parts of the front and back knitted fabric parts on one leg side starts until the inside leg joining parts on the one leg sides are joined together. Also, at least one of the front and back knitted fabric parts is subjected to the widening-for-expansion process to increase the number of stitches or the doubling-for-contraction process to reduce the number of stitches from the time the knitting to set up and knit the inside leg joining part of the front and back knitted fabric parts on the other leg side until they are joined together at the side parts thereof on the other leg side.

It is preferable that the doubling-for-contraction process or the widening-for-expansion process is done in proximity to the inside leg joining parts. The doubling-for-contraction process or the widening-for-expansion process may be done in proximity to the side parts.

The term of the doubling-for-contraction process used herein means that a length of the knitted fabric is shortened at the joining parts thereof by overlapping loops of the knitted fabric at appropriate points in the knitting width direction. The term of the widening-for-expansion process used herein means that a length of the knitted fabric is elongated at the joining parts thereof by increasing the number of stitches of the knitted fabric at appropriate points in the knitting width direction.

The knit pants may be knitted to have a side pocket. In this case, before the front and back knitted fabric parts are knitted setting up at the side part on the one leg side, a pocket part is knitted to be in the form of a closed-end pocket. Then, the front and back knitted fabric parts are knitted setting up at the side part on the one leg side so that a pocket opening can be formed in the side part thereof. Then, the front and back knitted fabric parts are knitted to be continuous to the side parts and the pocket opening.

Further, another pocket may be formed in the side part on the other leg side in the following manner. When the side parts of the front and back knitted fabric parts on the other leg side are subjected to the bond-off process, the side parts on the other leg side except the pocket opening is bound off, remaining the pocket opening unbound off. Then, the pocket part is knitted in tubular form by being knitted to be continuous from the pocket opening. Then, front and back knitted fabric parts of the pocket are joined together by the bind-off process.

The present invention also provides knit pants knitted using a flat knitting machine having at least a pair of front and back needle beds extending in a transverse direction and disposed opposite to each other in a cross direction, at least either of which is capable of being racked in the transverse direction so that loops can be transferred between the front and back needle beds, the knit pants being knitted in such a manner that the knitting starts at a side part on either right leg side or left leg side including a side part of a vertical rise part and a leg part and ends at a side part on the other leg side including a side part of a vertical rise part and a side part of a leg part and that the front and back knitted fabric parts of the vertical rise part and leg part on the one leg side are joined together at the side part by the set-up knitting and the front and back knitted fabric parts of the leg part are joined together and bound off at the inside leg joining part and, then, the front and back knitted fabric parts of the leg parts on the other leg side are joined together at the inside leg joining part by the set-up knitting and the front and back knitted fabric parts of the vertical rise part and leg part on the other leg side are joined together and bound off at the side part, so that a length (a thigh width) of the front knitted fabric part extending from the side to the crotch becomes shorter than a length (a thigh width) of the back knitted fabric part extending from the side to the crotch.

In the knit pants of the present invention, it is preferable that the both inside leg joining parts are made correspond in length to each other and the length under the crotch of the back knitted fabric part is made shorter than that of the front knitted fabric part. In order to make the both inside leg joining parts correspond in length to each other, at least one of the front knitted fabric part and the back knitted fabric part on one leg side is subjected to a doubling-for-contraction process to reduce the number of stitches or a widening-for-expansion process to increase the number of stitches from the time the knitting to set up and knit the side part on one leg side until the inside leg joining parts on the one leg side are joined together and at least one of the front knitted fabric part and the back knitted fabric part on the other leg side is subjected to the widening-for-expansion process to increase the number of stitches or the doubling-for-contraction process to reduce the number of stitches from the time the knitting to set up and knit the inside leg joining parts on the other leg side starts until the side parts on the other leg side are joined together.

It is preferable that the doubling-for-contraction process or the widening-for-expansion process are done in proximity to the inside leg joining parts of the right leg side and the left leg side. The doubling-for-contraction process or the widening-for-expansion process may be done in proximity to the side parts of the right leg side and the left leg side.

In the knit pants of the present invention, a bag-like pocket part may be joined to the side part of the vertical rise part in a seamless manner.

Also, the present invention provides a knitting program for letting a computerized flat knitting machine knit pants under commands mentioned below, for production of the knit pants that fits beautifully to one's body, the computerized flat knitting machine comprising at least a pair of front and back needle beds extending in a transverse direction and disposed opposite to each other in a cross direction, at least either of which is capable of being racked in the transverse direction so that loops can be transferred between the front and back needle beds:

a: a command to start knitting from a side part on either right leg side or left leg side including a side part of a vertical rise part and a side part of a leg part and stop knitting at a side part on the other leg side including a side part of a vertical rise part and a side part of a leg part, b: a command to knit so that a length (a thigh width) of the front knitted fabric part from the side to the crotch can be made shorter than a length (a thigh width) of the back knitted fabric part from the side to the crotch, c: a command to knit and join in the following steps under the commands a, b described above:

in the 1st step, the knitting to set up to join and knit the side parts of the front and back knitted fabric parts on the one leg side, the side parts including the side parts of the front and back knitted fabric parts of the vertical rise part and leg part is done, using front and back needle beds, in the 2nd step, the front and back knitted fabric parts on one leg side are knitted, wherein the vertical rise part and leg part of the front knitted fabric part are knitted, with the vertical rise part and leg part of the back knitted fabric part held to one of the needle beds, and also the vertical rise part and leg part of the back knitted fabric part are knitted, with the vertical rise part and leg part of the front knitted fabric part held to the other needle bed, in the 3rd step, the inside leg joining parts of the front and back knitted fabric parts of the leg part on the one leg side are joined together and bound off, in the 4th step, the knitting to set up to join and knit the inside leg joining parts of the front and back knitted fabric parts of the leg part on the other leg side is done, in the 5th step, the front and back knitted fabric parts on the other leg side are knitted, wherein the vertical rise part and leg part of the front knitted fabric part are knitted, with the vertical rise part and leg part of the back knitted fabric part held to one of the needle beds, and also the vertical rise part and leg part of the back knitted fabric part are knitted, with the vertical rise part and leg part of the front knitted fabric part held to the other needle bed, and in the 6th step, the side parts of the front and back knitted fabric parts on the other leg side are joined together and bound off, the side parts including the side parts of the front and back knitted fabric parts of the vertical rise part and leg part.

The knitting program is generated in CAD. The generated program is stored in recording media, such as a disc, for example, and the program stored in the recording media is read by a computer built in the flat knitting machine. Every mechanism of the flat knitting machine is driven in accordance with knitting commands from the knitting program, to knit the knit pants.

The CAD generates combined commands by combining commands to control the drives of the flat knitting machine for the knitting processes including the bind-off process, the widening process, the narrowing process, and the flechage knitting process with commands to specify shapes and sizes corresponding to those of the respective parts of the knitted fabric designed by a user and outputs those combined commands to the recording media in the form of knitting commands.

The CAD is constructed to include, for example, specifying means for specifying shapes and sides of the knit pants designed by a user, a memory for storing the knit pants' shapes and sides specified by the specifying means, size calculating means for calculating sizes of the respective knitting parts, such as the length above the crotch and the length under the crotch, of the knitting patterns to be knitted from the specified shapes and sizes read out from the memory, a memory in which the knitting processes including, for example, the bind-off process, the widening process, the narrowing process, and the flechage knitting process are stored, program generating means for generating a knitting program for letting the flat knitting machine knit the knit pants in accordance with the knitting sizes and a basic knitting method, and output means for outputting the generated knitting program to the recording media.

It is to be noted that the specified shapes include pants whose front and back knitted fabric parts are made to be equal to each other in length above the crotch and length under the crotch, pants whose front and back knitted fabric parts are made to be different from each other in length above the crotch and length under the crotch, and pants with side pocket. The specified sizes include ready-to-wear (ready-made product) sizes of ready-made pants, such as a small size (S), a medium size (M), a large size (L), or a nine, an eleven, etc., and exact sizes of each individual person.

It is to be noted that the knitting patterns indicates shapes of the respective parts of the pants including a right front knitted fabric part, a left front knitted fabric part, a right back knitted fabric part, and a left back knitted fabric part.

The knitting program of the present invention can allow the knit pants having a beautiful appearance and a beautiful fit to be knitted automatically by controlling the knitting drive of the flat knitting machine under the knitting commands from the knitting program of the present invention.

EFFECT OF THE INVENTION

The knitting method of the knit pants of the present invention can produce the knit pants that look more beautiful externally when a wearer puts on the knit pants. Especially, the knitting method of the present invention can allow the narrowing stitches and the widening stitches to be formed in the inside leg joining part which is located in a less visible place of the pants when wearing. In addition, since the courses knitted are oriented to the vertical direction to which the pants are oriented when a wearer puts on the pants, the pants can be knitted in swelled form by the flechage knitting. Hence, the knitting method of the present invention can produce the knitted pants that look more beautiful externally.

Further, when the knit pants after knitted are viewed in three dimensions, the back knitted fabric part becomes longer in length connecting between a center position of the waist part and a joining point of the crotch part (Cf. the length (C-E) of the front knitted fabric part and the length (c-e) of the back knitted fabric part in FIG. 1, for example) due to the difference in thigh width between the front knitted fabric part and the back knitted fabric part. As a result, when the tubular waist part after knitted is viewed from top, the joining point of the crotches where the front and back knitted fabric parts on the right and left leg sides are all joined together come closer to the front body with respect to the center of the waist part. This can produce the knitted pants that fit more beautifully to one's body when wearing, because the human body usually has the structure that the rear part of the human trunk extending from side to hip is larger in thickness than the front part of the human trunk extending from side to belly.

Also, in the knitting method of the present invention, the front and back knitted fabric parts are knitted so that the length under the crotch of the front knitted fabric part can be made longer than that of the back knitted fabric part. As a result of this, the back knitted fabric part comes to be longer in length connecting between a center position of the waist part and a joining point of the crotch part. This can produce a further swelled hip part of the knit pants, thus providing a more beautiful fit.

Also, in the knitting method of the present invention, when the doubling-for-contraction process or the widening-for-expansion process is done in proximity to the inside leg joining parts, the widening stitches and the narrowing stitches formed are put in the shade, so that the knitted pants are improved in visual quality.

Also, when the doubling-for-contraction process or the widening-for-expansion process is done in proximity to the side parts as well, the widening stitches and the narrowing stitches formed can be put in the shade to be as less visible as possible.

When the knit pants are knitted to have side pockets, a bag-like side pocket is joined to the side part by being knitted to extend continuously from the side part. The side pocket thus knitted can serve a good function as a pocket and further can contribute to formation of a beautiful appearance of the knit pants with the side pocket.

Further, the knit pants of the present invention look beautiful externally when wearing. Also, when the knit pants after knitted are viewed in three dimensions, the joining point of the crotches comes closer to the front body with respect to the center of the waist parts due to the difference in thigh width between the front knitted fabric part and the back knitted fabric part. This can make the knitted pants fit beautifully to one's body when wearing.

Further, in the knit pants of the present invention, the front and back knitted fabric parts are knitted so that the front knitted fabric part can be made longer in length under the crotch. As a result of this, the back knitted fabric part comes to be longer in length connecting between a center position of the waist part and a joining point of the crotch part. This can further enlarge a naturally swelled hip part of the knit pants when wearing, thus providing a more beautiful fit. Particularly when the doubling-for-contraction process or the widening-for-expansion process is done in proximity to the inside leg joining parts or in proximity to the side part, the widening stitches and the narrowing stitches formed are put in the shade, so that the knit pants are improved in visual quality. Further, the knit pants with pockets of the present invention come to have a beautiful appearance in that the bag-like pocket is seamlessly joined to the side part of the vertical rise part of the pants.

In addition, the knit pants that look beautiful externally when wearing can be knitted automatically by the flat knitting machine using the knitting program of the present invention for knitting the knit pants.

BEST MODE FOR CARRYING OUT THE INVENTION

In the following, preferred embodiments of knitting method of knit pants of the present invention and preferred embodiments of knit pants knitted by the same knitting method of the present invention will be described with reference to the accompanying drawings.

In the illustrated embodiments, knit pants are knitted using a so-called two-bed flat knitting machine having a pair of front and back needle beds extending in a transverse direction and disposed opposite to each other in a cross direction, the back needle bed being capable of being racked in the transverse direction so that loops can be transferred between the front and back needle beds.

When the knit pants are knitted using the two-bed flat knitting machine, they are knitted with every other needles of each of the front and back needle beds. For example, the front knitted fabric part is knitted primarily with odd needles of the front needle bed and the back knitted fabric part is knitted primarily with even needles of the back needle bed.

Further, when the two-bed flat knitting machine is used to knit the knit pants, the back knitted fabric parts are held to the needles of the back needle bed in the knitting of the front knitted fabric parts, while on the other hand, the front knitted fabric parts are held to the needles of the front needle bed in the knitting of the back knitted fabric parts, so that the front and back fabric parts are knitted with being overlapped in front and back. This can provide the result that the empty needles used for loop transfer of the respective knitted fabric parts can always be kept on the opposite needle beds.

Through the use of these empty needles, knitting patterns of mixed front-and-back stitches, such as links, purl stitch, and ribs, can be knitted and also the knitting loops in the front and back knitted fabrics can be transferred in the knitting width to be joined to each other. It is to be noted that in the embodiments illustrated below, the front and back knitted fabric parts are knitted in plain knitting.

The two-bed flat knitting machine may be provided with a transfer jack bed(s) having transfer jacks arranged in line thereon and located over either or both of the front and back needle beds, for knitting the knitted fabrics.

As an alternative to the two-bed flat knitting machine used in the illustrated embodiments, a four-bed flat knitting machine comprising an upper front needle bed, a lower front needle bed, an upper back needle bed, and a lower back needle bed may be used for knitting the knit pants.

When the four-bed flat knitting machine is used, for example the front knitted fabric parts are held to the lower front needle bed and the back knitted fabric parts are held to the lower back needle bed, initially. Then, the upper back needle bed is used in the form of empty needle for loop transfer of the front knitted fabric parts when knitted, and the upper front needle bed is used in the form of empty needle for loop transfer of the back knitted fabric parts when knitted.

First Embodiment

First, first embodiments, cited as one of certain preferred embodiments of a knitting method of knit pants of the present invention and one of certain preferred embodiments of the knit pants knitted by the knitting method of the present invention, will be described with reference to FIGS. 1 to 3. In the knit pants of the first embodiment, the front knitted fabric part and the back knitted fabric part are equal to each other in length under the crotch from the crotch to the hem of the leg as well as in length under the crotch from the crotch to the waist, but are different in thigh width from each other in that the thigh width of the front knitted fabric part from the side to the crotch is narrower than that of the back knitted fabric part.

The knit pants of the first embodiment are produced by the process of knitting their front and back knitted parts having the leg parts, the hip parts, and the waist parts, followed by joining them together in a seamless manner, using the two-bed flat knitting machine.

FIG. 1 is a part drawing, viewed from top, of knit pants 1, showing that their front knitted parts 2, 3 and back knitted parts 4, 5 knitted by a knitting method of the first embodiment are in the overlapped state. FIGS. 2 and 3 show the knitting process drawings for the knitting of the knit pants of the first embodiment.

As shown in FIG. 1, the front knitted fabric parts 2, 3 have a right front waist part 21, a right front hip part 22, a right front leg part 23, a left front waist part 31, a left front hip part 32, and a left front leg part 33, and the back knitted fabric parts 4, 5 have a right back waist part 41, a right back hip part 42, a right back leg part 43, a left back waist part 51, a left back hip part 52, and a left back leg part 53.

Further, the front and back knitted fabric parts on the right and left leg sides have hems 24, 44, 34, 54, crotch parts E, e, J, j, inside leg joining parts 25, 45, 35, 55, and side parts 61, 62 extending continuously to the waist parts, the hip parts, and leg parts. The part extending from the crotch E, e, J, j to the waist 21, 41, 31, 51 comes to be a vertical rise part.

In this embodiment, the front knitted fabric parts and the back knitted fabric parts are equally sized in width of the hem 24, 44, 34, 54 and in length under the crotch (x) from the hem 24, 44, 34, 54 to the crotch part E, e, J, j, while on the other hand, a thigh width (y) of the front knitted fabric parts 2,3 from the side part 61, 62 to the crotch part E, J is narrower than a thigh width (z) of the back knitted fabric parts 4,5 from the side part 61, 62 to the crotch part e,j, as shown in FIG. 1.

In this embodiment, the knitting starts at the side part 61 of the right leg and ends at the side part 62 of the left leg, when viewed in FIG. 1. It is to be noted that in the first embodiment and in the second and third embodiments mentioned later, the terms, "right leg" and "left leg" used herein mean that they are on the right side and on the left side when viewed from a person putting on the knit pants 1.

The knitting procedure of the knit pants 1 of the first embodiment will be described in detail with reference to FIGS. 2 and 3. In this embodiment, the back knitted fabric parts 4, 5 are knitted primarily with even needles on the back needle bed and the front knitted fabric parts 2, 3 are knitted primarily with odd needles on the front needle bed.

First, the knitting to set up and knit the side part 61 (AB, ab) of the front and back knitted fabric parts on the right leg side is done, as shown in FIG. 2(1), feeding a knitting yarn to the front and back needle beds from either of the yarn feeders (not shown) which are respectively prepared for the knitting of the front knitted fabric parts and for the knitting of the back knitted fabric parts. After the set-up knitting, the right front knitted fabric part 2 and the right back knitted fabric part 4 are knitted up to K-D and k-d, respectively, feeding the knitting yarns from the front and back yarn feeders to the front and back needle beds, respectively. The knitting of the part of the right front knitted fabric part 2 surrounded by ABDK in FIG. 2(1) and the knitting of the part of the right back knitted fabric part 4 surrounded by abdk in FIG. 2(1) are concluded with this knitting.

Then, the part of the right front knitted fabric part 2 surrounded by KDEC is knitted, as shown in FIG. 2(2). This knitting is done by a flechage knitting, during which the knitting of the right back knitted fabric part 4 is brought to rest. After completion of the knitting of the part of the right front knitted fabric part 2 surrounded by KDEC, the part of the right back knitted fabric part 4 surrounded by kdec is knitted, as shown in FIG. 2(3). This knitting is also done by the flechage knitting, during which the knitting of the right front knitted fabric part 2 is brought to rest.

Then, the inside leg joining part 25 (the part ED) of the right front knitted fabric part 2 and the inside leg joining part 45 (the part ed) of the right back knitted fabric part 4 are made to correspond in length to each other by overlapping their loops. Thereafter, the inside leg joining parts 25, 45 are joined together and then bound off, as shown in FIG. 2(4). The leg parts on the right leg side are formed in tubular form by the bind-off process.

Then, the left waist parts 31, 51 and the left leg parts 33, 53 are knitted. The bind-off process of the right leg parts results in providing the empty needles to which the front and back knitting needles as were used for knitting the leg parts are changed. Through the use of the empty needles the knitting to set up and knit the inside leg joining part 35 (the part JG) of the left front knitted fabric part 3 and the inside leg joining part 55 (the part jg) of the left back knitted fabric part 5 is done, as shown in FIG. 2(5).

Then, the part of the left front knitted fabric part 3 surrounded by FJGM is knitted, as shown in FIG. 3(6). This knitting is done by the flechage knitting, during which the knitting of the left back knitted fabric part 5 is brought to rest. After completion of the knitting of the part of the left front knitted fabric part 3 surrounded by FJGM, the part of the left back knitted fabric part 5 surrounded by fjgm is knitted, as shown in FIG. 3(7). This knitting is also done by the flechage knitting, during which the knitting of the left front knitted fabric part 3 is brought to rest.

Then, the part of the left front knitted fabric part 3 surrounded by MGIH and the part of the left back knitted fabric part 5 surrounded by mgih is knitted, as shown in FIG. 3(8). Finally, the left front knitted fabric part 3 and the left back knitted fabric part 5 are joined to each other at the side part 62 (HI, hi) and bound off, as shown in FIG. 3(9). The leg parts, hip parts, waist parts on the left leg side are formed in tubular form by the bind-off process.

As a result of the knitting processes mentioned above, the knit pants whose front and back leg parts on the right and left sides are joined to each other at the crotch parts E, e, J, j are formed.

In this embodiment, the crotch parts E, e, J, j of the knit pants are placed so that the front knitted fabric parts and the back knitted fabric parts can be made different in thigh width when the knit pants 1 are viewed in three dimensions, whereby a length (c-e) connecting between a center position of their waist parts and a joining point of their crotch parts of the back knitted fabric parts is longer than a length (C-E) connecting between a center position of their waist parts and a joining point of their crotch parts of the front knitted fabric parts. As a result, when the tubular waist part of the pants after knitted is viewed from top, the joining point of the crotch parts where the front and back knitted fabric parts on the right and left sides are all joined together comes closer to the front body with respect to the center of the waist part. This can produce the knitted pants 1 that fit more beautifully to one's body when wearing, because the human body usually has the structure that the rear part of the human trunk extending from side to hip is larger in thickness than the front part of the human trunk extending from side to belly.

Second Embodiment

Next, second embodiments will be described with reference to FIGS. 4 to 6. In the second embodiments as well, the knit pants are produced by the process of knitting their front and back knitted parts having the leg parts, the hip parts, and the waist parts, followed by joining them together in a seamless manner, using the two-bed flat knitting machine.

In the second embodiment, the back knitted fabric parts are shorter in crotch height than the front knitted fabric parts and also the front knitted fabric parts are narrower in thigh width from the side part to the crotch part than the back knitted fabric parts.

FIG. 4 is a part drawing of the knit pants 1, showing that their front knitted parts 2, 3 and back knitted parts 4, 5 are in the overlapped state. FIGS. 5 and 6 show the knitting process drawings for the knitting of the knit pants of the second embodiment.

In the second embodiment, like reference characters are labeled to corresponding parts to those of the first embodiment and the explanation thereon is omitted. In this embodiment, the front knitted fabric parts and the back knitted fabric parts are equally sized in width of the hem 24, 44, 34, 54. The crotch height (w) of the back knitted fabric parts 4, 5 from the hem 24, 44, 34, 54 to the crotch part E, e, J, j is shorter than the crotch height (x) of the front knitted fabric parts 2, 3, while on the other hand, the thigh width (y) of the front knitted fabric parts 2, 3 from the side part 61, 62 to the crotch part E, J are narrower than the thigh width (z) of the back knitted fabric parts 4, 5 from the side 61, 62 to the crotch e, j, as shown in FIG. 4.

In this embodiment as well, the knitting starts at the side part 61 on the right leg side and ends at the side part 62 on the left leg side, when viewed in FIG. 4.

The knitting procedures of the knit pants 1 of the second embodiment will be described in detail with reference to FIGS. 5 and 6. In this embodiment as well, the back knitted fabric parts 4, 5 are knitted primarily with even needles on the back needle bed and the front knitted fabric parts 2, 3 are knitted primarily with odd needles on the front needle bed.

First, the knitting to set up and knit the side part 61 (AB, ab) of the front and back knitted fabric parts on the right leg side is done, as shown in FIG. 5(1), feeding a knitting yarn to the front and back needle beds from either of the yarn feeders (not shown) which are respectively prepared for the knitting of the front knitted fabric parts and for the knitting of the back knitted fabric parts. After the set-up knitting, the right front knitted fabric part 2 and the right back knitted fabric part 4 are knitted up to K-D and k-d, respectively, feeding the knitting yarns from the front and back yarn feeders to the front and back needle beds, respectively. The knitting of the part of the right front knitted fabric part 2 surrounded by ABDK in FIG. 5(1) and the knitting of the part of the right back knitted fabric part 4 surrounded by abdk in FIG. 5(1) are concluded with this knitting.

Then, the part of the right front knitted fabric part 2 surrounded by KDEC is knitted, as shown in FIG. 5(2). This knitting is carries out by the flechage knitting, during which the knitting of the right back knitted fabric part 4 is brought to rest. Further, in this embodiment, since the crotch height (x) of the right front knitted fabric part 2 is longer than the crotch height (w) of the right back knitted fabric part 4, the inside leg joining part 25 of the front right leg part 23 and the inside leg joining part 45 of the back right leg part 43 must be made equal in length to each other before they are joined to each other. Accordingly, when the inside leg part between ED is knitted while the part of the right front knitted fabric part 2 surrounded by KDEC is knitted by the flechage knitting, double stitches are formed at appropriate points in the inside leg part to shift the crotch E to the right side as viewed in FIG. 5, which is called "doubling for contraction". The double stitches may be formed in the course of the knitting of the part surrounded by KDEC or may alternatively be formed at appropriate points in the inside leg joining parts 25, 45 at the completion of the knitting of the part surrounded by KDEC. When the double stitches are formed in the course of the knitting of the part surrounded by KDEC, it is preferable that the double stitches are formed at locations as close to the inside leg joining parts 25, 45 as possible.

After completion of the knitting of the part of the right front knitted fabric part 2 surrounded by KDEC, the part of the right back knitted fabric part 4 surrounded by kdec is knitted, as shown in FIG. 5(3). This knitting is done by the flechage knitting, during which the knitting of the right front knitted fabric part 2 is brought to rest.

Then, the inside leg joining part 25 (the part ED) of the right front knitted fabric part 2 and the inside leg joining part 45 (the part ed) of the right back knitted fabric part 4 are made to correspond in length to each other by overlapping their loops. Thereafter, the inside leg joining parts 25, 45 are joined together and then bound off, as shown in FIG. 5(4). The leg parts on the right leg side are formed in tubular form by the bind-off process.

Then, the left waist parts 31, 51 and the left leg parts 33, 53 are knitted. The bind-off process of the right leg parts results in providing the empty needles to which the front and back knitting needles as were used for knitting the right leg parts are changed. Through the use of the empty needles the knitting to set up and knit the inside leg joining part 35 (the part JG) of the left front knitted fabric part 3 and the inside leg joining part 55 (the part jg) of the left back knitted fabric part 5 is done, as shown in FIG. 5(5). In this knitting process, after several courses of the left front knitted fabric part 3 are knitted in a knitting width identical with jg, the knitting width of JG is widened by the widening knitting. This process of knitting several courses in the knitting width of jg can facilitate increase the number of stitches of the left front knitted fabric part 3.

Then, the part of the left front knitted fabric part 3 surrounded by FJGM is knitted, as shown in FIG. 6(6). This knitting is done by the flechage knitting, during which the knitting of the left back knitted fabric part 5 is brought to rest. After completion of the knitting of the part of the left front knitted fabric part 3 surrounded by FJGM, the part of the left back knitted fabric part 5 surrounded by fjgm is knitted, as shown in FIG. 6(7). This knitting is also done by the flechage knitting, during which the knitting of the left front knitted fabric part 3 is brought to rest. Then, the part of the left front knitted fabric part 3 surrounded by MGIH and the part of the left back knitted fabric part 5 surrounded by mgih are knitted concurrently, as shown in FIG. 6(8). It is necessary for joining together the left front knitted fabric part 3 and the left back knitted fabric part 5 at the side part 62 (HI, hi) that the loops of the front knitted fabric parts and the loops of the back knitted fabric parts are made to confront each other, as shown in FIG. 6(9). For this, the back needle bed is racked rightward so that the loops of the respective knitted fabric parts can correspond to each other at the side part 62 (HI, hi).

The left front knitted fabric part 3 and the left back knitted fabric part 5 are joined together at the side part 62 (HI, hi) and bound off, as shown in FIG. 6(10). The leg parts, the hip parts, and the waist parts on the left leg side are respectively formed in tubular form by the bind-off process.

As a result of the knitting processes mentioned above, the knit pants whose front and back leg parts on the right and left sides are joined together at the crotch parts E, e, J, j are formed.

In this embodiment as well, the crotch parts E, e, J, j of the knit pants are placed so that the front knitted fabric parts and the back knitted fabric parts can be made different in thigh width when the knit pants 1 are viewed in three dimensions, whereby the length (c-e) of the back knitted fabric parts is longer than the length (C-E) of the front knitted fabric parts, as shown in FIG. 4. As a result, when the tubular waist part of the pants after knitted is viewed from top, the joining point of the crotch parts where the front and back knitted fabric parts on the right and left sides are all joined together comes closer to the front body with respect to the center of the waist part. This can produce the knit pants 1 that fit more beautifully to one's body when wearing, because the human body usually has the structure that the rear part of the human trunk extending from the side to the hip is larger in thickness than the front part of the human trunk extending from the side to the belly.

Further, in this embodiment, since the front and back knitted fabric parts are knitted in such a manner that the crotch height of the front knitted fabric parts can be made larger than that of the back knitted fabric parts, the length c-e of the back knitted fabric parts comes to be longer. This can further enlarge the swelled hip parts of the knitted pants 1, thus producing the knit pants that fit more beautifully to one's body when wearing.

Third Embodiment

Next, third embodiments will be described with reference to FIGS. 7 to 8. In the third embodiments as well, the knit pants are produced by the process of knitting their front and back knitted parts having the leg parts, the hip parts, and the waist parts, followed by joining them together in a seamless manner, using the two-bed flat knitting machine.

In the third embodiment, the knit pants 1 having the same shape as the second embodiment shown in FIG. 4 are formed in another knitting method.

In this embodiment as well, the knitting starts at the side part 61 of the right leg and ends at the side part 62 of the left leg, when viewed in FIG. 4.

First, the knitting to set up and knit the side part 61 (AB, ab) of the front and back knitted fabric parts 2, 4 on the right side is done, as shown in FIG. 7(1), feeding a knitting yarn to the front and back needle beds from either of the yarn feeders (not shown) which are respectively prepared for the knitting of the front knitted fabric parts and for the knitting of the back knitted fabric parts. After the set-up knitting, the right front knitted fabric part 2 and the right back knitted fabric part 4 are knitted up to K-D and k-d, respectively, feeding the knitting yarns from the front and back yarn feeders to the front and back needle beds, respectively. The knitting of the part of the right front knitted fabric part 2 surrounded by ABDK in FIG. 7(1) and the knitting of the part of the right back knitted fabric part 4 surrounded by abdk in FIG. 7(1) are concluded with this knitting.

Then, the part of the right front knitted fabric part 2 surrounded by KDEC is knitted, as shown in FIG. 7(2). This knitting is done by the flechage knitting, during which the knitting of the right back knitted fabric part 4 is brought to rest.

After completion of the knitting of the part of the right front knitted fabric part 2 surrounded by KDEC, the part of the right back knitted fabric part 4 surrounded by kdec is knitted, as shown in FIG. 7(3). This knitting is done by the flechage knitting, during which the knitting of the right front knitted fabric part 2 is brought to rest.

Further, in this embodiment, since the crotch heights of the front knitted fabric parts 2, 3 are longer than the crotch heights of the back knitted fabric parts 4, 5, the inside leg joining part 25 of the front right leg part 23 and the inside leg joining part 45 of the back right leg part 43 must be made equal in length to each other before they are joined to each other. Accordingly, when the inside leg part between ed is knitted while the part of the right back knitted fabric part 4 surrounded by kdec is knitted by the flechage knitting, widening stitches are formed at appropriate points in the inside leg part to shift the crotch part e to the left side as viewed in FIG. 7, which is called "widening for expansion". The widening stitches may be formed in the course of the knitting of the part surrounded by kdec or may alternatively be formed at appropriate points in the inside leg joining part 45 at the completion of the knitting of the part surrounded by kdec. When the widening stitches are formed in the course of the knitting of the part surrounded by kdec, it is preferable that the widening stitches are formed in close proximity to the inside leg joining part 45.

Then, the inside leg joining part 25 (the part ED) of the right front knitted fabric part 2 and the inside leg joining part 45 (the part ed) of the right back knitted fabric part 4 are made to correspond in length to each other by overlapping their loops. Thereafter, the inside leg joining parts 25, 45 are joined together and then bound off, as shown in FIG. 7(4). The leg parts on the right leg side are formed in tubular form by the bind-off process.

Then, the left waist parts 31, 51 and the left leg parts 33, 53 are knitted. The bind-off process of the right leg parts results in providing the empty needles to which the front and back knitting needles as were used for knitting the right leg parts are changed. Through the use of the empty needles the knitting to set up and knit the inside leg joining part 35 (the part JG) of the left front knitted fabric part 3 and the inside leg joining part 55 (the part jg) of the left back knitted fabric part 5 is done, as shown in FIG. 7(5). In this knitting process, after several courses of the left back knitted fabric part 5 are knitted in a knitting width identical with JG, the knitting width is narrowed to jg by the narrowing knitting. This process of knitting several courses in the knitting width of JG can facilitate decrease of the number of stitches of the left back knitted fabric part 5.

Then, the part of the left front knitted fabric part 3 surrounded by FJGM is knitted, as shown in FIG. 8(6). This knitting is done by the flechage knitting, during which the knitting of the back knitted fabric part 5 is brought to rest. After completion of the knitting of the part of the left front knitted fabric part 3 surrounded by FJGM, the part of the left back knitted fabric part 5 surrounded by fjgm is knitted, as shown in FIG. 8(7). This knitting is also done by the flechage knitting, during which the knitting of the left front knitted fabric part 3 is brought to rest.

Then, the part of the left front knitted fabric part 3 surrounded by MGIH and the part of the left back knitted fabric part 5 surrounded by mgih are knitted, as shown in FIG. 8(8). It is necessary for joining together the left front knitted fabric part 3 and the left back knitted fabric part 5 at the side part 62 (HI, hi) that the loops of the front knitted fabric part and the loops of the back knitted fabric part are made to confront each other, as shown in FIG. 8(9). For this, the back needle bed is racked rightward so that the loops of the respective knitted fabric parts can correspond to each other at the side part 62 (HI, hi), as shown in FIG. 8(9). Then, the left front knitted fabric part 3 and the left back knitted fabric part 5 are joined together at the side part 62 (HI, hi) and bound off, as shown in FIG. 8(10). The leg parts, the hip parts, and the waist parts on the left leg side are respectively formed in tubular form by the bind-off process.

As a result of the knitting processes mentioned above, the knit pants having substantially the same shape as the second embodiment whose front and back leg parts on the right and left sides are joined to each other at the crotch parts E, e, J, j are formed.

Although the embodiments wherein the widening-for-expansion process and the doubling-for-contraction process are both taken on the inside leg joining part side have been described above, they may be altered as follows. After setting up at the side part on one leg side, at least one of the front and back knitted fabric parts are knitted up to their inside leg joining parts, with being subjected to the doubling-for-contraction process or the widening-for-expansion process, and then bound off. Then, after the knitting to set up and knit the inside leg joining part of the front knitted fabric part and the back knitted fabric part on the other leg side is done, the front and back knitted fabric parts are knitted to proximity to the side part on the other leg side. Thereafter, at least one of the front and back knitted fabric parts is subjected to the widening-for-expansion process or the doubling-for-contraction process before joined at the side part thereof on the other leg side. Then, at least one of the front and back knitted fabric parts is joined at the side part on the other leg side and then bound off.

Although, for convenience of explanation, the front knitted fabric parts 2, 3 and back knitted fabric parts 4, 5 of the knit pants 1 of the embodiments described above are presented in the form of a plain knit structure with no pattern, they may have another knit structure, such as jacquard and rib.

In the knitting method of the present invention, the knit pants may be knitted to include an elastic band in the waist part or may be knitted so that while the waist part is knitted, a tubular elastic band separately knitted on the needle bed can be joined to the waist part.

Also, when the leg parts are knitted, several wales of the hems (e.g. BD, bd, GI, gi in FIG. 1) of the leg parts may be knitted in purl stitch. Also, the leg parts may be knitted in such a manner that tubular double jersey parts which are knitted separately while the leg parts are knitted are joined to the hems. Further, the leg parts may be knitted in tights or stocking form by joining socks parts to the hems.

The knitting of the first embodiment illustrated in FIG. 2(2),(3) and FIG. 3(6),(7), the knitting of the second embodiment illustrated in FIG. 5(2)(3) and FIG. 6(6),(7), and the knitting of the third embodiment illustrated in FIG. 7(2),(3), and FIG. 8(6),(7) may proceed concurrently without bringing either the front knitted fabric parts or the back knitted fabric parts to rest.

Further, the front and back knitted fabric parts may be knitted to include a bag-like pocket. In this case, before the knitting to set up and knit the side part is done, the knitting to set up and knit a pocket part on one leg side is done so that the pocket part on one leg side is knitted in the form of a closed-end pocket. Then, the knitting to set up and knit the side parts on one leg side is done, with an opening of the pocket part open. Thereafter, the front and back knitted fabric parts are knitted to be continuous to the side part and the pocket opening, thereby forming the pocket in the one leg side. When another pocket is formed in the side part on the other leg side, the front and back knitted fabric parts are bound off at the side part thereof on the other leg side, remaining the opening of the pocket unbound off. Thereafter, the pocket part is knitted in tubular form by being knitted continuously from the pocket opening and, then, the front and back knitted fabric parts of the pocket are joined together by the bind-off process, thereby forming the pocket.

As the bag-like pockets can be joined to the side parts in this manner, the pockets can serve a good function as a pocket. Further, the knit pants with side pockets thus knitted can obtain a beautiful appearance.

The present invention also provides a program for letting a computerized flat knitting machine knit pants under commands mentioned below. The computerized flat knitting machine has at least a pair of front and back needle beds extending in a transverse direction and disposed opposite to each other in a cross direction, at least either of which is capable of being racked in the transverse direction so that loops can be transferred between the front and back needle beds.

As shown in a flowchart of FIG. 9, a command "a" to knit starting at the side part on either right leg side or left leg side including a side part of the vertical rise part and a side part of the leg part and stop knitting at the side part on the other leg side including a side part of the vertical rise part and a side part of the leg part is issued (determination of knitting direction), first. Then, a command "b" to knit so that a length (thigh width) of the front knitted fabric part from the side to the crotch can be made shorter than a length (thigh width) of the back knitted fabric part from the side to the crotch is issued (determination of thigh width). Then, a command "c" to knit and join is issued under the commands a, b in the following steps.

As to the command to knit and join, a command to do the knitting to set up to join and knit side parts of the front and back knitted fabric parts on the one leg side, the side parts including the side parts of the front and back knitted fabric parts of the vertical rise part and leg part, using the front and back needle beds, is first issued (1st step), and, then, a command to knit the front and back knitted fabric parts of the one leg side, wherein the vertical rise part and leg part of the front knitted fabric part are knitted, with the vertical rise part and leg part of the back knitted fabric part held to one of the needle beds, and also the vertical rise part and leg part of the back knitted fabric part are knitted, with the vertical rise part and leg part of the front knitted fabric part held to the other needle bed is issued (2nd step).

Then, a command to join together and bind off the inside leg joining parts of the front and back knitted fabric parts of the leg part on the one leg side is issued (3rd step). Then, a command to do the knitting to set up to join and knit the inside leg joining parts of the front and back knitted fabric parts of the leg part on the other leg side is issued (4th step). Then, a command to knit the front and back knitted fabric parts on the other leg side are knitted, wherein the vertical rise part and leg part of the front knitted fabric part are knitted, with the vertical rise part and leg part of the back knitted fabric part held to one of the needle beds, and also knit the front and back knitted fabric parts are knitted, wherein the vertical rise part and leg part of the back knitted fabric part are knitted, with the vertical rise part and leg part of the front knitted fabric part held to the other needle bed is issued (5th step). Then, a command to join together and bind off the side parts of the front and back knitted fabric parts (6th step). When the knitting performed under the command in the 6th step is ended, the knitting of the knit pants is ended.

This knitting program is generated in CAD. The generated program is stored in recording media, such as a disc, and the program stored in the recording media is read by the computer built in the flat knitting machine. Every mechanism of the flat knitting machine is driven in accordance with knitting commands from the knitting program, to knit the knit pants.

The CAD generates combined commands by combining commands to control the drives of the flat knitting machine for the bind-off process, the widening process, the narrowing process, the flechage knitting, and so on with commands to specify shapes and sizes corresponding to those of the respective parts of the knitted fabric designed by a user and outputs those combined commands to the recording media in the form of knitting commands.

The knitting commands are read from the recording media containing the knitting program of the present invention by a computer built in the flat knitting machine. The knit pants that look beautiful externally when wearing can be knitted automatically by knitting the knit pants in according to the knitting commands using the flat knitting machine.

Industrial Applicability

The knitting method of the present invention is suitably used for knitting the knit pants seamlessly, particularly for knitting the knit pants having a less-stretch knitting structure, such as a Milan rib, and an inlay structure seamlessly, using the flat knitting machine. Also, the knit pants of the present invention can be produced using the flat knitting machine. Further, the knitting program of the present invention can allow the automatic knitting of the knit pants that fit a wearer's figure by using the flat knitting machine.

EXPLANATION OF LETTERS OR NUMERALS

Figure 1:
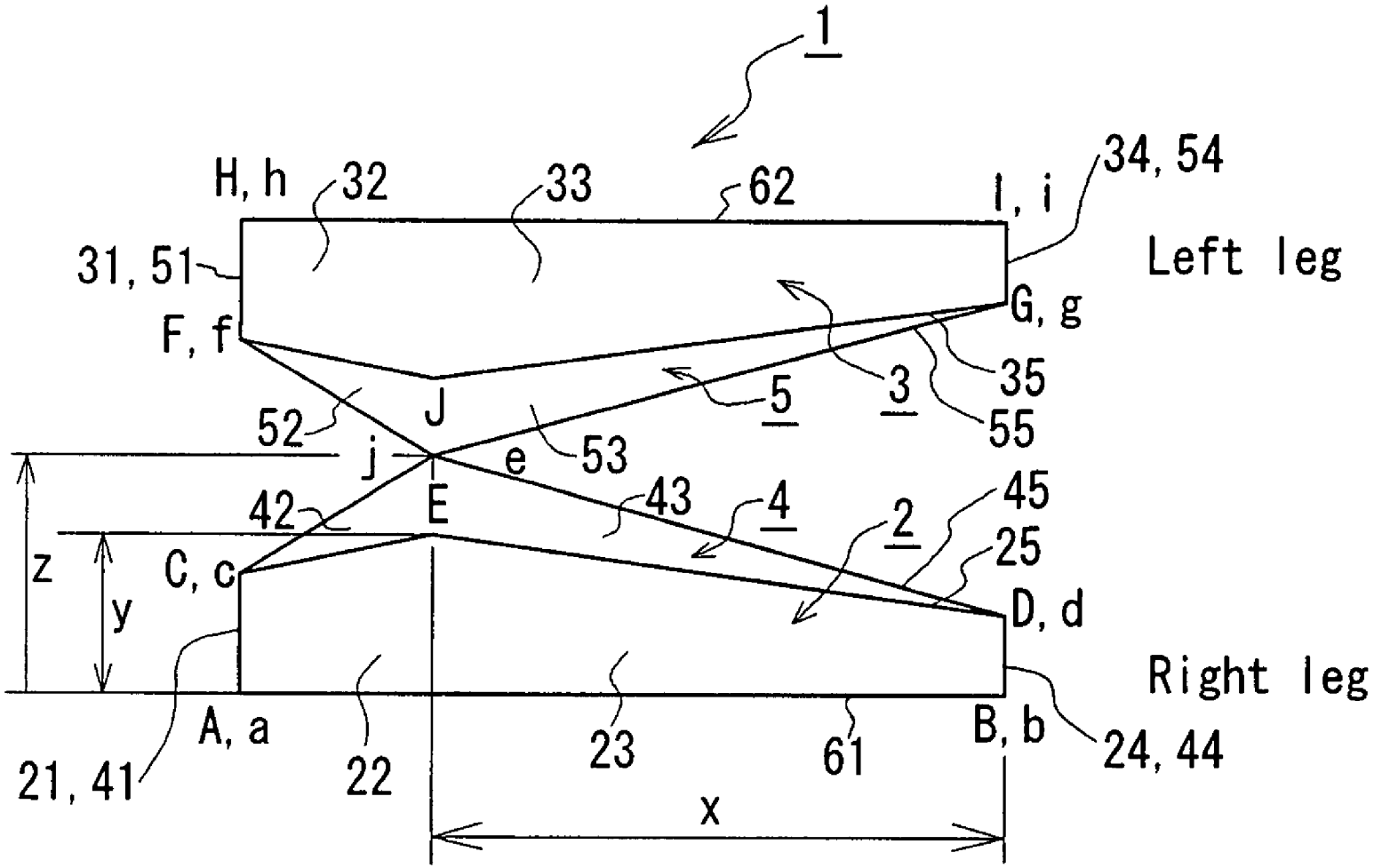
FIG. 1 is a part drawing, viewed from top, of long trousers type of knit pants of a first embodiment according to the present invention.
Figure 2:
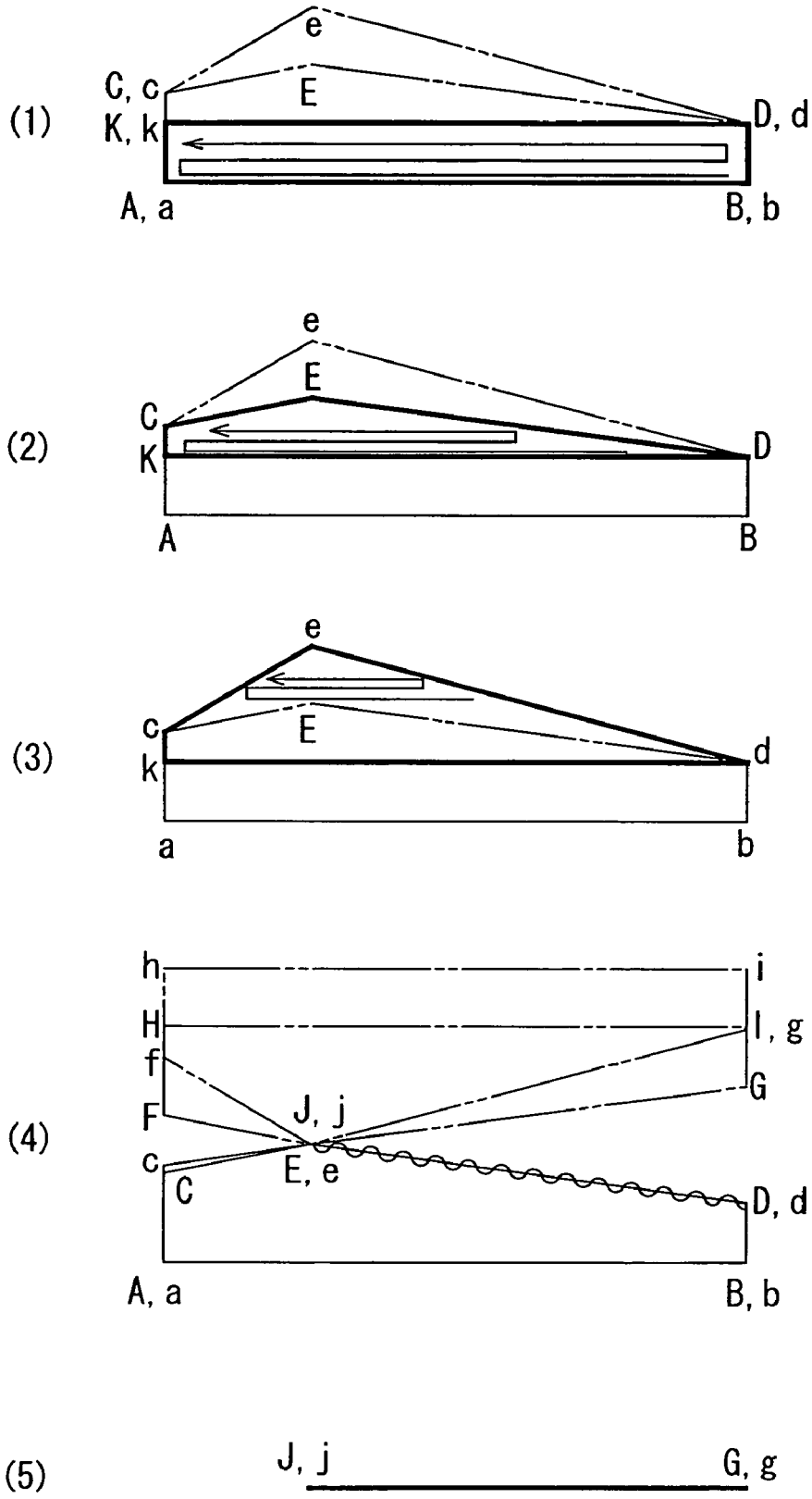
FIG. 2 is a knitting process drawing of the knit pants of the first embodiment according to the present invention, FIG. 2(1) to (4) showing the knitting processes on the right leg side, and FIG. 2(5) showing the knitting to set up and knit the left leg parts.
Figure 3:
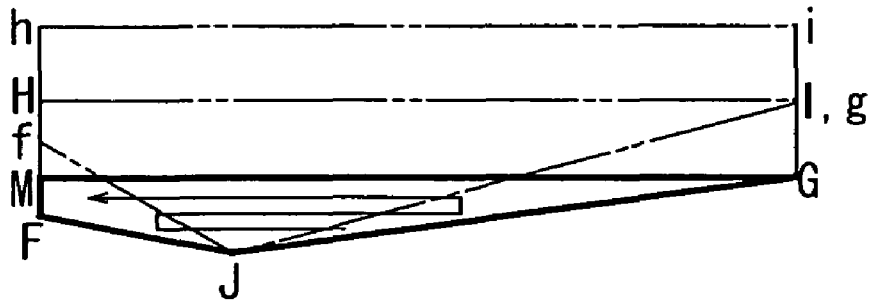
FIG. 3 is a knitting process drawing of the knit pants of the first embodiment according to the present invention, FIG. 3(6) to (9) showing the knitting processes on the left leg side.
Figure 3:
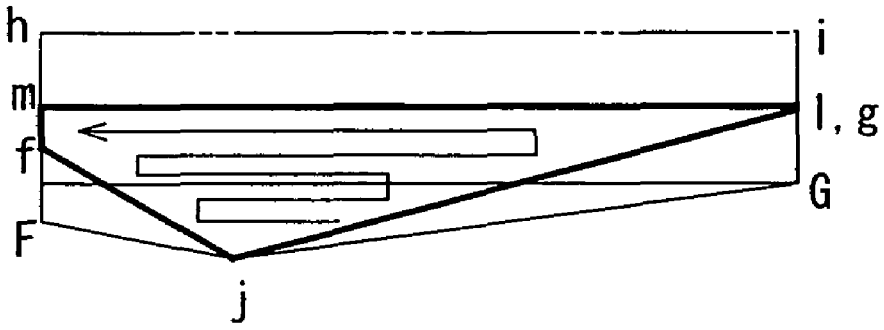
Figure 3:
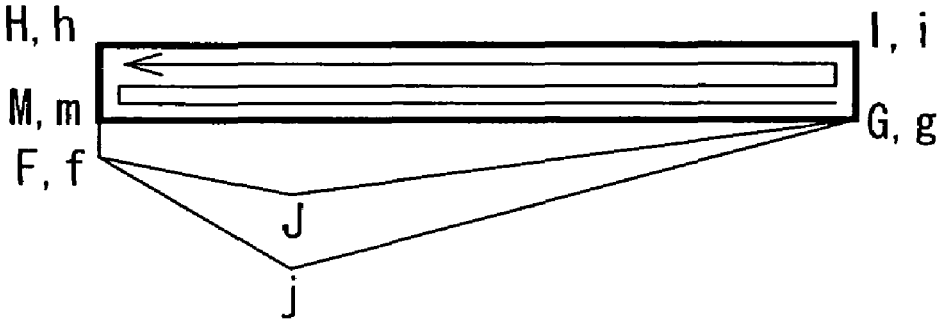
Figure 3:
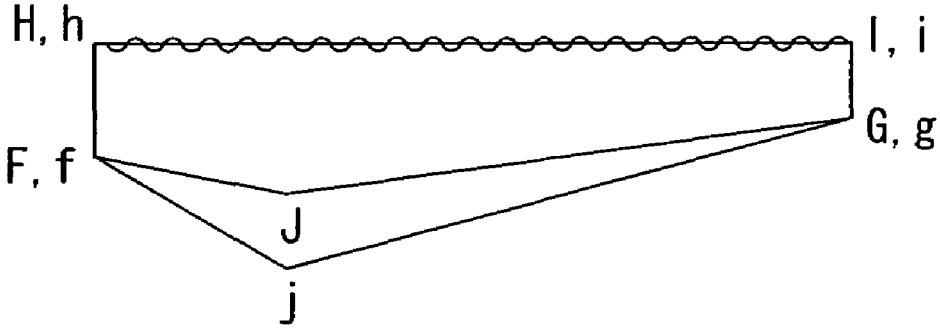
Figure 4:
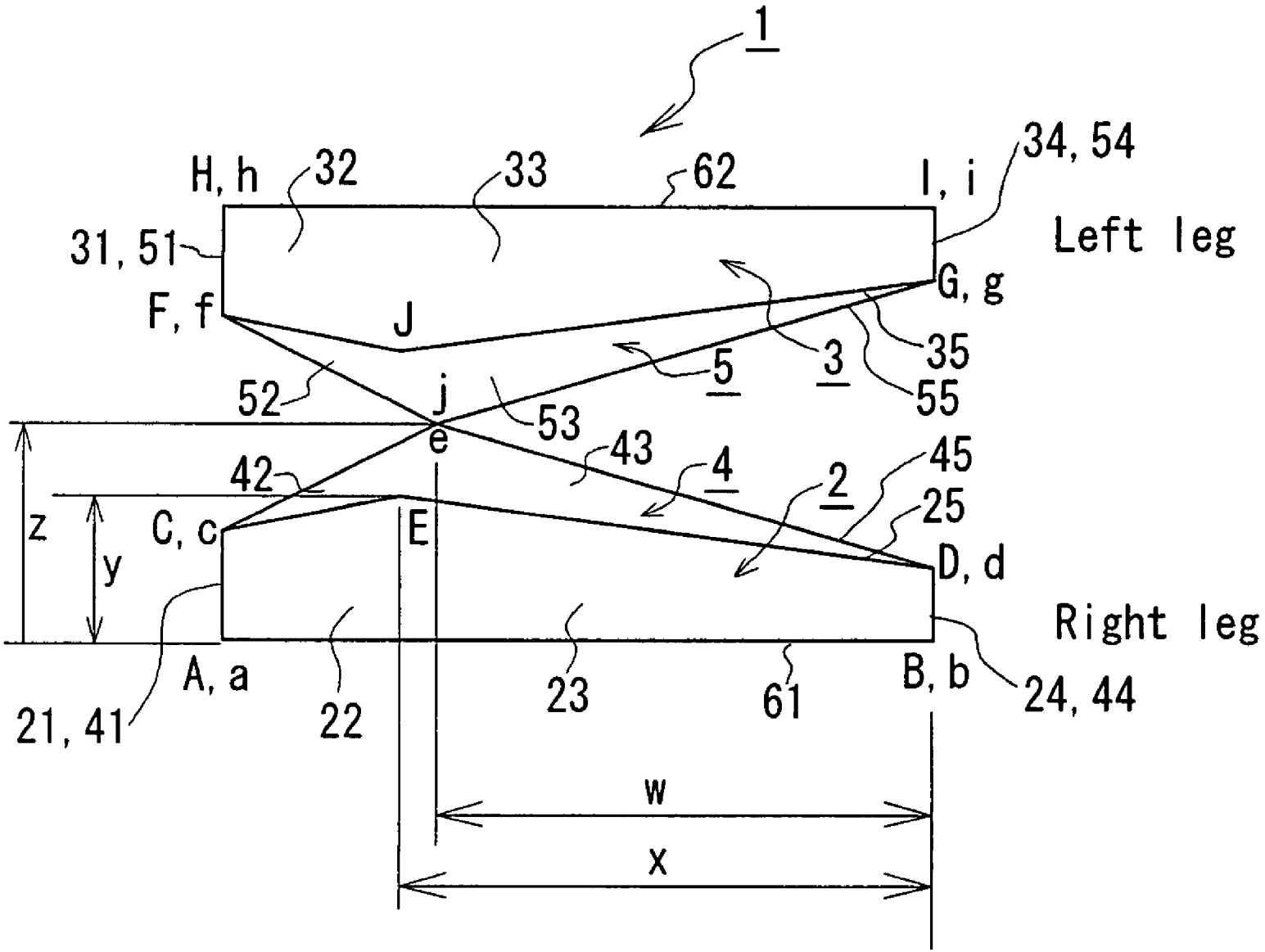
FIG. 4 is a part drawing, viewed from top, of long trousers type of knit pants of a second embodiment according to the present invention.
Figure 5:
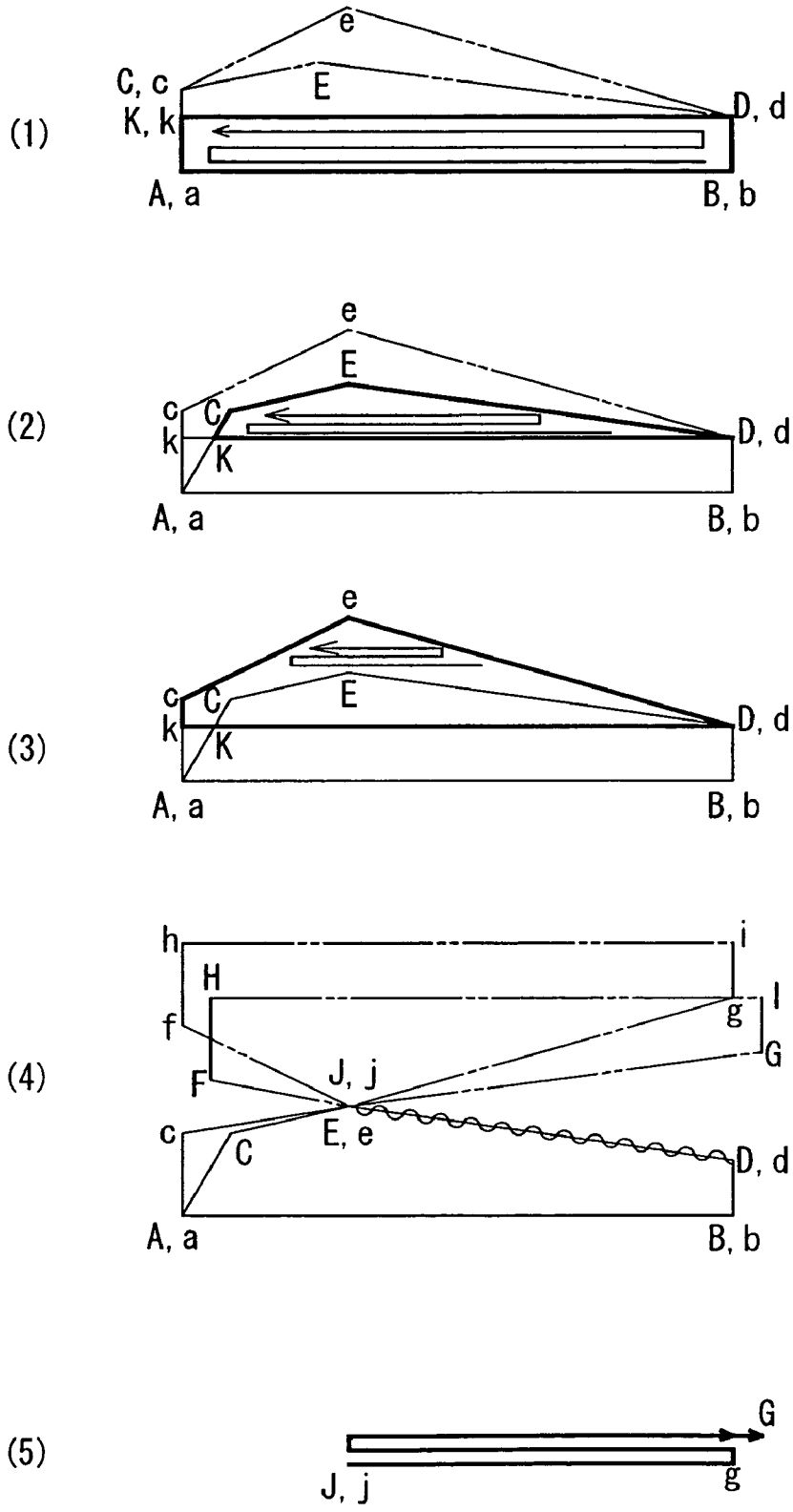
FIG. 5 is a knitting process drawing of the knit pants of the second embodiment according to the present invention, FIG. 5(1) to (4) showing the knitting processes on the right leg side, and FIG. 5(5) showing the knitting to set up and knit the left leg parts.
Figure 6:
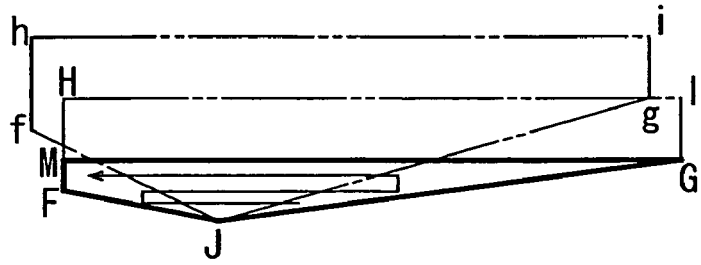
FIG. 6 is a knitting process drawing of the knit pants of the second embodiment according to the present invention, FIG. 5(6) to (10) showing the knitting processes on the left leg side.
Figure 6:
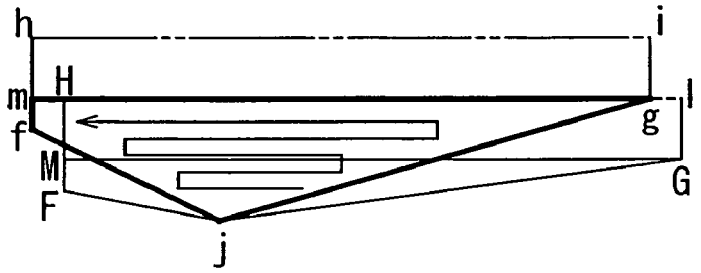
Figure 6:
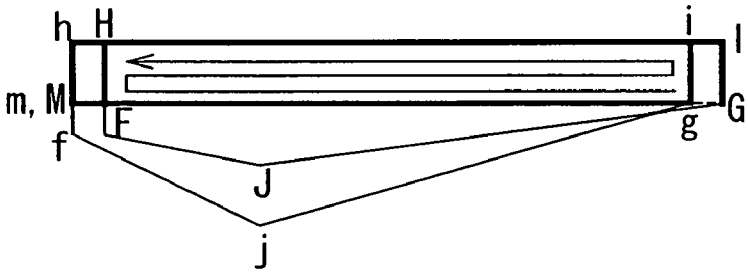
Figure 6:
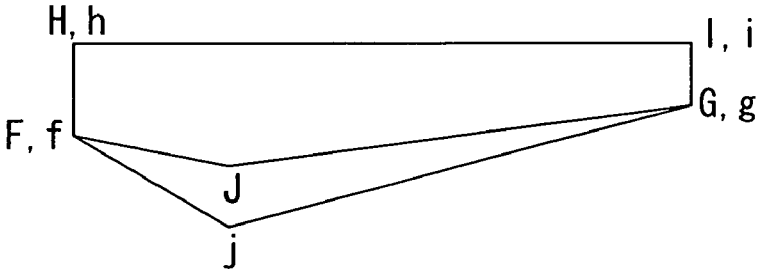
Figure 6:
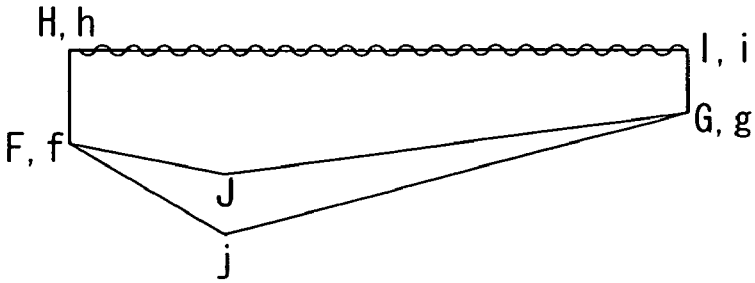
Figure 7:
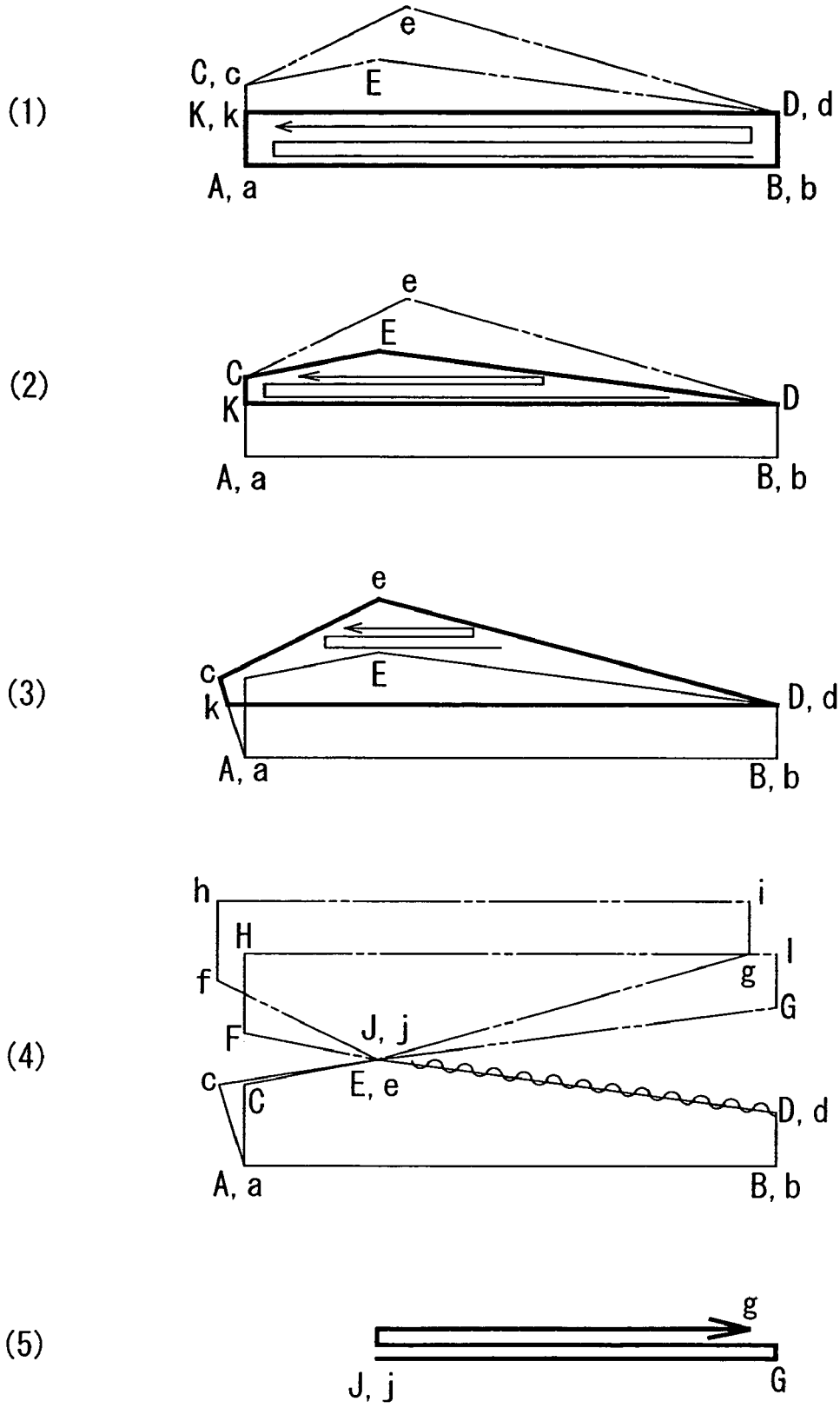
FIG. 7 is a knitting process drawing of the knit pants of a third embodiment according to the present invention, FIG. 7(1) to (4) showing the knitting processes on the right leg side, and FIG. 7(5) showing the knitting to set up and knit the left leg parts.
Figure 8:
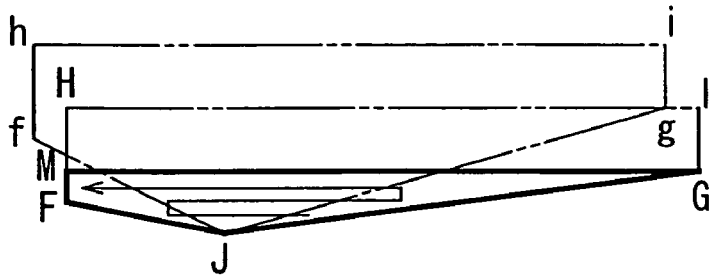
FIG. 8 is a knitting process drawing of the knit pants of the third embodiment according to the present invention, FIG. 8(6) to (10) showing the knitting processes on the left leg side.
Figure 8:
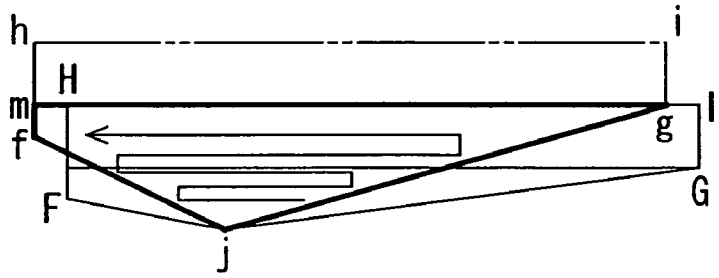
Figure 8:
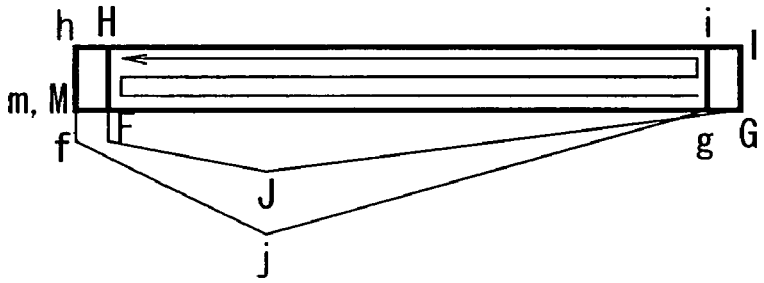
Figure 8:
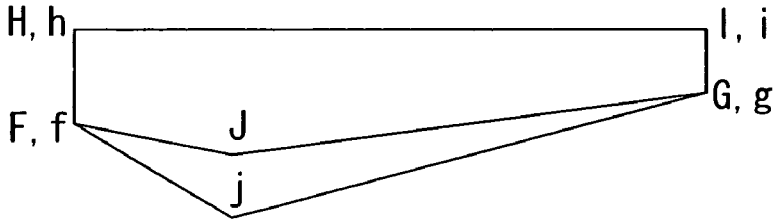
Figure 8:
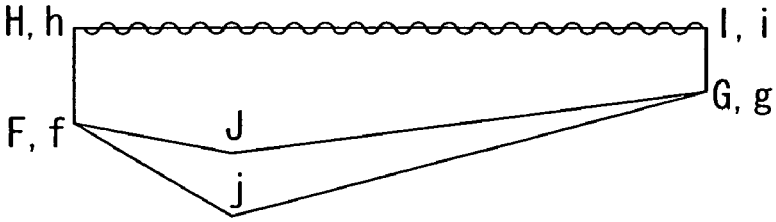
Figure 9:
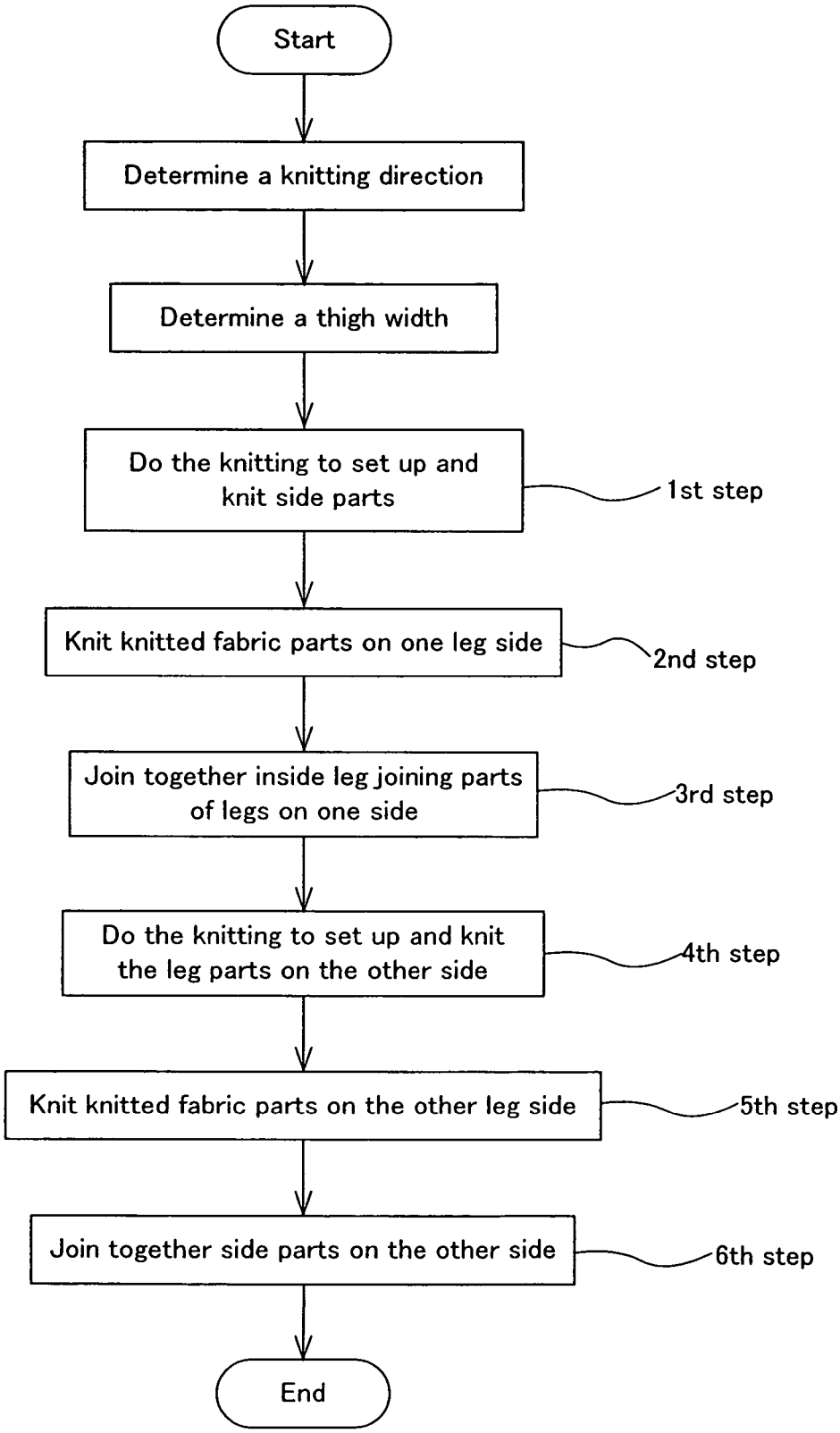
FIG. 9 is a flowchart showing the control procedure of knitting the knit pants in accordance with knitting commands of a knitting program according to the present invention.

| | |
|---|---|
| 1: Knit pants | 2: Right front knitted fabric part |
| 21: Right front waist part | 22: Right front hip part |
| 23: Right front leg part | 24: Right hem part |
| 25: Right front inside leg joining part | |
| 3: Left front knitted fabric part | 31: Left front waist part |
| 32: Left front hip part | 33: Left front leg part |
| 34: Left front hem part | 35: Left front inside leg joining part |
| 4: Right back knitted fabric part | |
| 41: Right back waist part | 42: Right back hip part |
| 43: Right back leg part | 44: Right back hem part |
| 45: Right back inside leg joining part | |
| 5: Left back knitted fabric part | 51: Left back waist part |
| 52: Left back hip part | 53: Left back leg part |
| 54: Left back hem part | 55: Left back inside leg joining part |
| 61: Right side part | 62: Left side part |
| E, e, J, j: Crotch part | |

The invention claimed is:

1. A knitting method of knit pants knitted using a flat knitting machine having at least a pair of front and back needle beds extending in a transverse direction and disposed opposite to each other in a cross direction, at least either of which is capable of being racked in the transverse direction so that loops can be transferred between the front and back needle beds, wherein the knitting starts at a side part on either right leg side or left leg side including a side part of a vertical rise part and a side part of a leg part and ends at a side part on the other leg side including a side part of a vertical rise part and a side part of a leg part, and a front knitted fabric part and a back knitted fabric part are knitted in the following steps so that a length (a thigh width) of the front knitted fabric part from the side to the crotch is shorter than a length (a thigh width) of the back knitted fabric part from the side to the crotch, said steps comprising:

the first step of doing the knitting to set up to join and knit the side parts of the front and back knitted fabric parts on the one leg side, the side parts including the side parts of the front and back knitted fabric parts of the vertical rise part and leg part, using the front and back needle beds, the second step of knitting the front and back knitted fabric parts of the one leg side, knitting the vertical rise part and leg part of the front knitted fabric part, with the vertical rise part and leg part of the back knitted fabric part held to one of the needle beds, and also knitting the vertical rise part and leg part of the back knitted fabric part, with the vertical rise part and leg part of the front knitted fabric part held to the other needle bed, the third step of joining together and binding off inside leg joining parts of the front and back knitted fabric parts of the leg parts on the one leg side, the forth step of doing the knitting to set up to join and knit the inside leg joining parts of the front and back knitted fabric parts of the leg parts on the other leg side, the fifth step of knitting the front and back knitted fabric parts on the other leg side, knitting the vertical rise part and leg part of the front knitted fabric part, with the vertical rise part and leg part of the back knitted fabric part held to one of the needle beds, and also knitting the vertical rise part and leg part of the back knitted fabric part, with the vertical rise part and leg part of the front knitted fabric part held to the other needle bed, and the sixth step of joining together and binding off the side parts of the front and back knitted fabric parts on the other leg side, the side parts including the side parts of the front and back knitted fabric parts of vertical rise part and leg part.

2. The knitting method of knit pants according to claim 1, wherein at least one of the front knitted fabric part and the back knitted fabric part is subjected to a doubling-for-contraction process to reduce the number of stitches or a widening-for-expansion process to increase the number of stitches from the time the knitting to set up and knit the side parts of the front and back knitted fabric parts on one leg side starts until the inside leg joining parts on the one leg side are joined together and also is subjected to the widening-for-expansion process to increase the number of stitches or the doubling-for-contraction process to reduce the number of stitches from the time the knitting to set up and knit the inside leg joining parts of the front and back knitted fabric parts on the other leg side until the side parts of the front and back knitted fabric parts on the other leg side are joined together so that the front and back knitted fabric parts can be knitted so that the length under the crotch of the back knitted fabric part can be made shorter than that of the front knitted fabric part and also the inside leg joining part of the front knitted fabric part and the inside leg joining part of the back knitted fabric part can be made correspond in length to each other when joined together.

3. The knitting method of knit pants according to claim 2, wherein the doubling-for-contraction process or the widening-for-expansion process is done in proximity to the inside leg joining parts.

4. The knitting method of knit pants according to claim 2, wherein the doubling-for-contraction process or the widening-for-expansion process is done in proximity to the side parts.

5. The knitting method of knit pants according to claim 1, wherein before the knitting to set up and knit the side parts of the front and back knitted fabric parts on the one leg side is done, the knitting to set up and knit a pocket part is done so that the pocket part can be knitted in the form of a closed-end pocket, then the knitting to set up and knit the side parts of the front and back knitted fabric parts on the one leg side is done so that a pocket opening can be formed in the side parts, and then the front and back knitted fabric parts are knitted to be continuous to the side parts and the pocket opening.

6. The knitting method of knit pants according to claim 1, wherein when the side parts of the front and back knitted fabric parts on the other leg side are bound off, remaining the pocket opening unbound off, and, then, the pocket part is knitted in tubular form by being knitted to be continuous from the pocket opening and then front and back knitted fabric parts of the pocket part are joined together by the bind-off process.

7. Knit pants knitted using a flat knitting machine having at least a pair of front and back needle beds extending in a transverse direction and disposed opposite to each other in a cross direction, at least either of which is capable of being racked in the transverse direction so that loops can be transferred between the front and back needle beds, the knit pants being knitted in such a manner:

that the knitting starts at a side part on either right leg side or left leg side including a side part of a vertical rise part and a side part of a leg part and ends at a side part on the other leg side including a side part of a vertical rise part and a side part of a leg part, and that the front and back knitted fabric parts of the vertical rise part and leg part on the one leg side are joined together at the side part by the set-up knitting and the front and back knitted fabric parts of the leg part are joined together and bound off at the inside leg joining part and, then, the front and back knitted fabric parts of the leg part on the other leg side are joined together at the inside leg joining part by the set-up knitting and the front and back knitted fabric parts of the vertical rise part and leg part on the other leg side are joined together and bound off at the side part, so that a length (a thigh width) of the front knitted fabric part extending from the side to the crotch becomes shorter than a length (a thigh width) of the back knitted fabric part extending from the side to the crotch.

8. The knit pants according to claim 7, wherein at least one of the front knitted fabric part and the back knitted fabric part on the one leg side is subjected to a doubling-for-contraction process to reduce the number of stitches or a widening-for-expansion process to increase the number of stitches from the time the knitting to set up and knit the front and back knitted fabric parts at the side part on the one leg side starts until they are joined together at the inside leg joining part on the one leg side and at least one of the front knitted fabric part and the back knitted fabric part on the other leg side is subjected to the widening-for-expansion process to increase the number of stitches or the doubling-for-contraction process to reduce the number of stitches from the time the knitting to set up and knit the front and back knitted fabric parts at the inside leg joining part on the other leg side starts until they are joined together at the side part on the other leg side, whereby the both inside leg joining parts are made correspond in length to each other and also the length under the crotch of the back knitted fabric parts are made shorter than that of the front knitted fabric parts.

9. The knit pants according to claim 8, wherein the doubling-for-contraction process or the widening-for-expansion process is done in proximity to the inside leg joining parts of the right leg side and the left leg side.

10. The knit pants according to claim 8, wherein the doubling-for-contraction process or the widening-for-expansion process is done in proximity to the side parts of the right leg side and the left leg side.

11. The knit pants according to claim 7, wherein a bag-like pocket part is joined to the side part of the vertical rise part in a seamless manner.

12. A computer-readable medium storing executable instructions for letting a computerized flat knitting machine knit pants the computerized flat knitting machine comprising at least a pair of front and back needle beds extending in a transverse direction and disposed opposite to each other in a cross direction, at least either of which is capable of being racked in the transverse direction so that loops can be transferred between the front and back needle beds, by performing operations comprising:

a: a command to start knitting from a side part on either right leg side or left leg side including a side part of a vertical rise part and a side part of a leg part and stop knitting at a side part on the other leg side including a side part of a vertical rise part and a side part of a leg part, b: a command to knit so that a length (a thigh width) of the front knitted fabric part from the side to the crotch can be made shorter than a length (a thigh width) of the back knitted fabric part from the side to the crotch, and c: a command to knit and join in the following steps under the commands a, b described above:

in the 1st step, the knitting to set up to join and knit the side parts of the front and back knitted fabric parts on the one leg side, the side parts including the side parts of the front and back knitted fabric parts of the vertical rise part and leg part, using front and back needle beds, in the 2nd step, the front and back knitted fabric parts on one leg side are knitted, wherein the vertical rise part and leg part of the front knitted fabric part are knitted, with the vertical rise part and leg part of the back knitted fabric part held to one of the needle beds, and also the vertical rise part and leg part of the back knitted fabric part are knitted, with the vertical rise part and leg part of the front knitted fabric part held to the other needle bed, in the 3rd step, the inside leg joining parts of the front and back knitted fabric parts of the leg part on the one leg side are joined together and bound off, in the 4th step, the knitting to set up to join and knit the inside leg joining parts of the front and back knitted fabric parts of the leg part on the other leg side is done, in the 5th step, the front and back knitted fabric parts on the other leg side are knitted, wherein the vertical rise part and leg part of the front knitted fabric part are knitted, with the vertical rise part and leg part of the back knitted fabric part held to one of the needle beds, and also the vertical rise part and leg part of the back knitted fabric part are knitted, with the vertical rise part and leg part of the front knitted fabric part held to the other needle bed, and in the 6th step, the side parts of the front and back knitted fabric parts on the other leg side are joined together and bound off, the side parts including the side part of the front and back knitted fabric parts of the vertical rise part and leg part.

* * * * *